US007097323B2

(12) United States Patent
Puckett

(10) Patent No.: US 7,097,323 B2
(45) Date of Patent: Aug. 29, 2006

(54) FLASHLIGHT SYSTEM

(76) Inventor: Brian Puckett, 2118 Willshire Blvd., #447, Santa Monica, CA (US) 90403

( * ) Notice: Subject to any disclaimer, the term of this patent is extended or adjusted under 35 U.S.C. 154(b) by 306 days.

(21) Appl. No.: 10/652,818

(22) Filed: Aug. 29, 2003

(65) Prior Publication Data

US 2005/0047125 A1 Mar. 3, 2005

(51) Int. Cl.
*F21L 4/00* (2006.01)

(52) U.S. Cl. ..... 362/202; 362/190; 362/206

(58) Field of Classification Search ..... 362/183, 362/184, 190, 191, 202, 205–206, 208
See application file for complete search history.

(56) References Cited

U.S. PATENT DOCUMENTS 3,835,272 A * 9/1974 Wisenbaker ..... 200/60
4,203,150 A 5/1980 Shamlian
4,531,178 A 7/1985 Uke
4,658,336 A 4/1987 Maglica
4,864,474 A 9/1989 Maglica
4,949,231 A 8/1990 Wang
5,126,927 A 6/1992 Reeves et al.
D335,192 S * 4/1993 Abel ..... D26/49
5,345,370 A 9/1994 Murray et al.
5,367,446 A 11/1994 Ellion
5,400,227 A 3/1995 Maglica et al.
5,440,463 A 8/1995 Ellion
5,459,649 A 10/1995 Ellion
5,475,575 A 12/1995 Chin-Hsiang
5,593,074 A * 1/1997 Matthews ..... 224/251
5,642,932 A 7/1997 Matthews
5,660,458 A 8/1997 Chabria
5,722,765 A 3/1998 Maglica
5,806,962 A 9/1998 Ellion
6,039,456 A 3/2000 Chabria
6,045,236 A 4/2000 Cheng et al.
6,168,288 B1 * 1/2001 St. Claire ..... 362/184
6,193,388 B1 2/2001 Halasz et al.
6,283,611 B1 9/2001 Sharrah et al.
6,467,930 B1 * 10/2002 Frick ..... 362/202
6,506,342 B1 1/2003 Frankel

* cited by examiner

*Primary Examiner*—Laura K. Tso
(74) *Attorney, Agent, or Firm*—Michael A. Shippey; Law Offices of Karla Shippey

(57) ABSTRACT

A focusable flashlight comprising of enlarged head and tail section designed to have substantially the same diameter as a means to facilitate solid and secure gripping and to facilitate rapid, secure stowage of the invention during highly stressful environments, such as combat, law enforcement, night watch, home guard, underwater diving and other situations where the user of a flashlight requires a high level of situational awareness and while in need of operating a flashlight with one hand without distraction. An optional lanyard and holster are designed to work with the flashlight.

19 Claims, 7 Drawing Sheets

D-5

FLASHLIGHT SYSTEM

BACKGROUND OF THE INVENTION

1. Field of the Invention

The present invention relates generally to a flashlight that is designed for secure, easy use and stowage, especially under stressful conditions (for example, in combat or while SCUBA diving) during which the user of the flashlight requires a high level of situational awareness and must be able to hold a flashlight securely and efficiently without diverting much attention to its operation.

The invention further relates a flashlight having an enlarged tail section, a similarly enlarged head, and a high-friction surface, such that the flashlight is easily and securely held and operated with one hand without distraction.

2. Description of the Related Art

Nowhere in the prior art is described a combat-oriented, focusable flashlight with the enlarged head and enlarged tail section of the present invention.

Matthews, in U.S. Pat. No. 5,642,932 claims a flashlight and method of use, the flashlight geared to combat, law enforcement, and similar stressful situations. The flashlight claims a tail-end switch that extends from the tail section. It claims a central tubular section holding the batteries ("battery barrel") that has a reduced-diameter portion and a retention shoulder spaced from the tail section. It claims an adjustable elastomeric ring around the reduced portion, said ring held in place by the retention shoulder, and said ring allowing for easy grasp and use with two adjacent fingers of the user's hand, as with a hypodermic syringe.

Unlike the Matthews patent, the present invention does not claim a flashlight body with a reduced-diameter portion of the battery barrel, but a body diameter that stays the same from head to tail. This uniform body diameter allows for increased body strength, and allows for simplification of any mechanism design to grip the flashlight body in order to attach it, for example, to a firearm, both being benefits over the prior art.

In addition, Matthews claims that the position of its separate "retention element" is adjustable by removable spacer elements. Such adjustability, with or without spacer elements, is not part of this invention, nor is it necessary.

Unlike prior flashlights, which often emphasize a separate retention element such as an elastomeric ring projecting from a portion of the flashlight, the present invention does not possess an external elastomeric ring, because the enlarged tail section eliminates the need for such a separate element. Furthermore, unlike soft and moveable ring elements, the enlarged tail section of the present invention provides a rigid, immovable element that prevents slippage of the hand gripping the flashlight.

Cheng et.al. in U.S. Pat. No. 6,045,236 describes a flashlight with a rotatable ring, which can turn the flashlight on and off, and also focus the flashlight, when said ring is rotated or turned.

This present invention differs from Cheng in that the internal focus ring is not mechanically linked to the flashlight's on and off switch. Furthermore, unlike the prior art, the present invention's internal focus ring is specifically designed to be impossible to move once the flashlight's component parts are assembled.

Chin-Hsiang in U.S. Pat. No. 5,475,575 depicts a flashlight that can be turned on and focused by rotating the head.

Unlike Chin-Hsiang, the present invention has a push button tail-end switch to turn on the flashlight. Furthermore, unlike Chin-Hsiang, the light beam of the present invention is adjusted by taking off the flashlight head and turning the internal focus ring so as to position the bulb either towards or away from the focal point of the reflector in order to produce either a broad or narrow beam.

SUMMARY OF THE INVENTION

The present invention relates generally to a flashlight that is designed for secure, easy use and stowage under stressful conditions such as occur during combat, during law enforcement operations, during private security activities, during personal home security activities, during SCUBA diving, during numerous outdoor activities such as hunting, hiking, or boating; and at any other time during which the user of the flashlight requires a high level of situational awareness and must be able to use a flashlight securely and efficiently without diverting much attention to its operation.

The invention further relates a flashlight having an enlarged tail section, a similarly enlarged head, and a high-friction surface, such that the flashlight is easily operated with one hand without distraction. The invention improves the gripping of the flashlight during all activities, such as holstering, unholstering, switching it on or off, or holding it in virtually any manner during normal use. Further, the invention provides for secure holstering whether inserted into the holster tail first or head first.

It is an object of the invention to combine the enlarged head and tail section with a midsection battery barrel of a length optimized to a wide range of hand sizes, or to a number of fingers with which the flashlight will be gripped. This provides a wedging effect on the user's fingers while gripping the flashlight barrel, making the flashlight less prone to being accidentally dropped.

It is another object of the invention to produce a wedging effect that automatically positions the user's hand on the flashlight in the same place during every use. The combination of the enlarged head, enlarged tail section, and a midsection battery barrel ensures that the user's hand will be correctly and automatically positioned for activation of the tail section switch.

It is another object of the invention to produce a wedging effect that allows user to have an immediate correct, secure grip on the flashlight even when the user's hands are cold, or weak, or slippery, or enclosed in heavy gloves. It is another object of the invention to provide an enlarged tail section as a means to stabilize the flashlight's position in user's hand when activating the tail-end switch with either thumb or forefinger. The enlarged tail section prevents the flashlight from shifting or slipping in the user's hand when the flashlight is turned on or off.

It is another object of the invention with the enlarged tail section to produce a significant, passive mechanical barrier at the rear of the flashlight to reduce the chance of accidentally dropping the flashlight. With the enlarged head and tail section, the invention is mechanically hindered from sliding out of the user's hand in either direction, which can easily occur with the following situations: a weak grip due to cold temperatures or injury; a slippery grip due to sweat, blood, or other fluids; an uncertain or compromised grip due to wearing gloves; or a momentary lapse of grip due to startle or loss of concentration. This invention provides mechanical slippage hindrance from the flashlight without reliance upon the body material, surface finish, engraving, or molded-in pattern, allowing the invention to be produced in different embodiments and materials.

It is another object of the invention to provide a means to precisely control the pressure on the switch when activating it with either thumb or forefinger. This feature allows the invention to be used in situations such as combat when one intends only to momentarily press the switch to either signal or to get an instantaneous glimpse of one's surroundings.

It is another object of the invention to facilitate a mechanically sound grip on both the head and tail of the flashlight when withdrawing it from its holster, even in situations where fingers or hand is slippery from sweat, blood, mud or other fluids; or weak from injury; or stiff or weak from cold or fatigue; or covered by a glove.

It is another object of the invention to provide ample gripping surface and leverage for a dedicated dive light version of the invention, in which the entire enlarged tail section is a twist-on/twist-off switch, thus eliminating water pressure activation.

It is another object of the invention to facilitate holstering the flashlight either tail first or head first with little or no reduction in flashlight security by the holster's locking device or pressure retention system. Thus the invention will be held securely in times of haste, inattention or diminished attention due to stress no matter which end of the flashlight is inserted into the holster first. While head-first holstering is the normal mode of carrying the flashlight ready for instant deployment, secure tail-first holstering is highly desirable when transporting a police duty belt or military web gear that has a holstered flashlight attached as part of the equipment because when bolstered in this manner the tail-end switch is protected from accidental activation inside the transport vehicle, bag, backpack, etc.

It is another object of the invention to facilitate tail first bolstering of the flashlight in the event that it is fitted with slip-on beam filters and beam shapers. Generally, beam filters and shapers are attached to the flashlight head by means of an elastomeric sleeve that presses over the flashlight head and remains in place due to friction. When such a device is in place, the flashlight cannot be secured, or even slid into, a holster that is designed to hold the flashlight in a head-down position. In the present invention, because the head and the tail section are manufactured to the same enlarged diameter, the flashlight can be slid tail-first into the holster and be held just as securely as if it had been holstered in the "normal" head down position.

It is another object of the invention to provide an effective means of preventing a lanyard attachment device, such as a ring or band, from slipping off the flashlight body. With the enlarged tail section, the invention requires no groove or other reduced area on the flashlight to be machined or molded into the barrel, which eliminates additional machining or manufacturing time and produces a weakened area in the flashlight body.

It is another object of the invention to provide a wider, and thus more stable, base for standing the flashlight on end as a stationary source of light.

It is another object of the invention to provide an optimum light beam focus by positioning the bulb manually before use. The bulb position can be adjusted by taking off the flashlight head and turning the internal adjustment ring to position the bulb either towards or away from the focal point of the reflector so as to produce either a narrow or broad beam.

DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as representative basis for teaching one skilled in the art to employ the present invention in virtually any appropriately detailed system, structure or manner.

Figure 1:
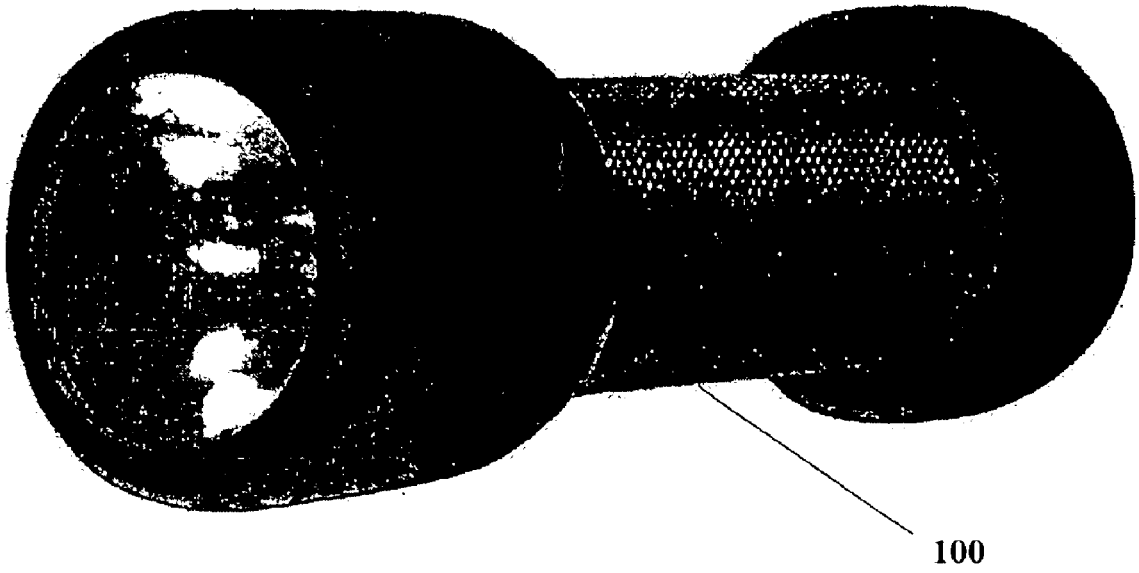
FIG. 1 Shows the current invention from a full side view.

The present invention is shown in exterior views in FIGS. 1–4. In FIG. 1, the flashlight 100 is shown from a front perspective view. The lens, head, and enlarged tail section can be seen. Also visible in this figure is the knurled body, the midsection separating the head and the tail.

The flashlight can be composed of any suitable material, such as hard plastic or metal, with glass or transparent plastic for the lens and bulb. Either aluminum or glass-filled nylon are the preferred materials of construction for the head bezel, body, and tail section, and indeed all exterior surfaces except lens and rear diaphragm. Said rear diaphragm is constructed from rubber, or a synthetic rubber-like material. Batteries are high-output lithium batteries or similar storage devices.

Figure 2:
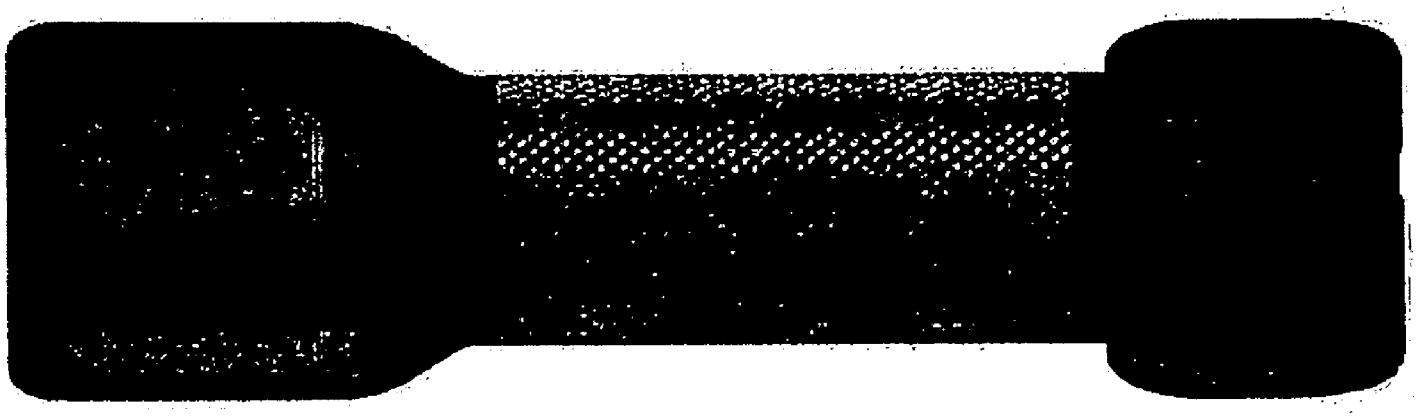
FIG. 2 Shows the invention from a front perspective view.

FIG. 2 shows the present invention from a side perspective. It is clear that the head and the enlarged tail section share the same diameter, which is important during operation. Again, the knurling of the midsection is visible. This aids in gripping the flashlight, especially in wet or otherwise slippery conditions.

Note that the end of the head is substantially flat, or slightly concave, such that the flashlight may rest in a stable manner in a vertical position above a supporting surface, with said end facing the supporting surface, and the body of the flashlight extending above said surface. Alternatively, as the tail section is also substantially flat on the outer surface, the flashlight may rest in a stable manner in a vertical position above a supporting surface, with said tail section resting on the supporting surface, and the body of the flashlight extending above said surface. In this manner, the flashlight, when activated, acts as a lamp, or similar stable source of light.

Figure 3:
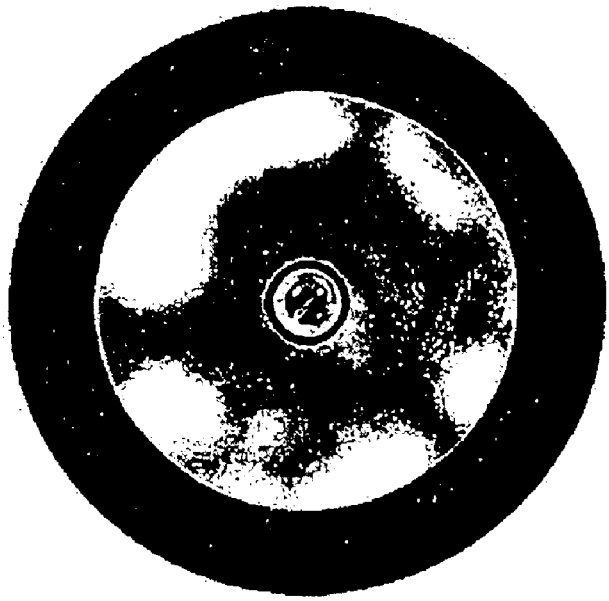
FIG. 3 Shows the current invention from a full front view.

FIG. 3 shows the head-on view of the present invention in an embodiment with incandescent light. This invention is contemplated for use with a variety of light sources compatible with the batteries as power supply. For instance, in another contemplated embodiment, a light-emitting diode (LED) device is utilized as light source. This will have essentially the same appearance that seen in FIG. 3 when viewed head-on.

Figure 4:
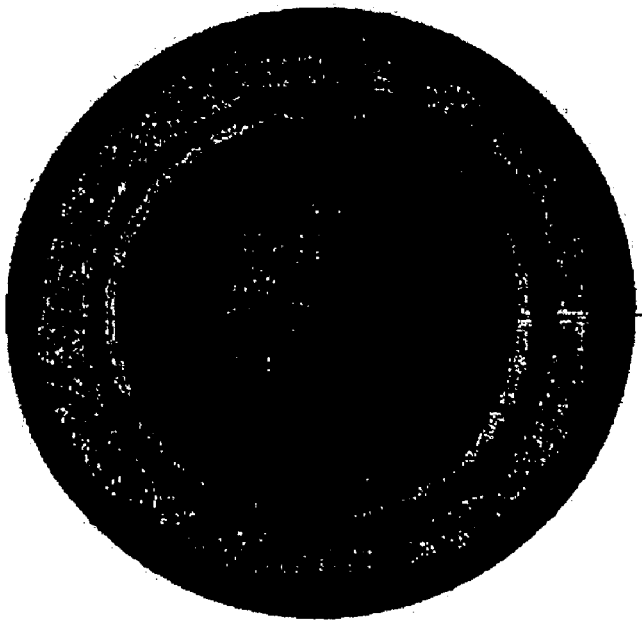
FIG. 4 Shows the current invention from a full rear view.

FIG. 4 shows a rear view of the present invention. In this common embodiment, the central elastomeric diaphragm 70 (here shown as black synthetic rubber) covers a pressure power switch. This makes for easy and rapid on/off switching of the light, using only a single finger or thumb.

In yet another embodiment of the present invention, the pressure switch is replaced with a twist switch. This is important in versions of the flashlight intended for underwater use. In this type of use, a pressure switch can be unintentionally activated by water pressure. Therefore a non-pressure switch is generally preferable in the underwater environment.

Figure 5:
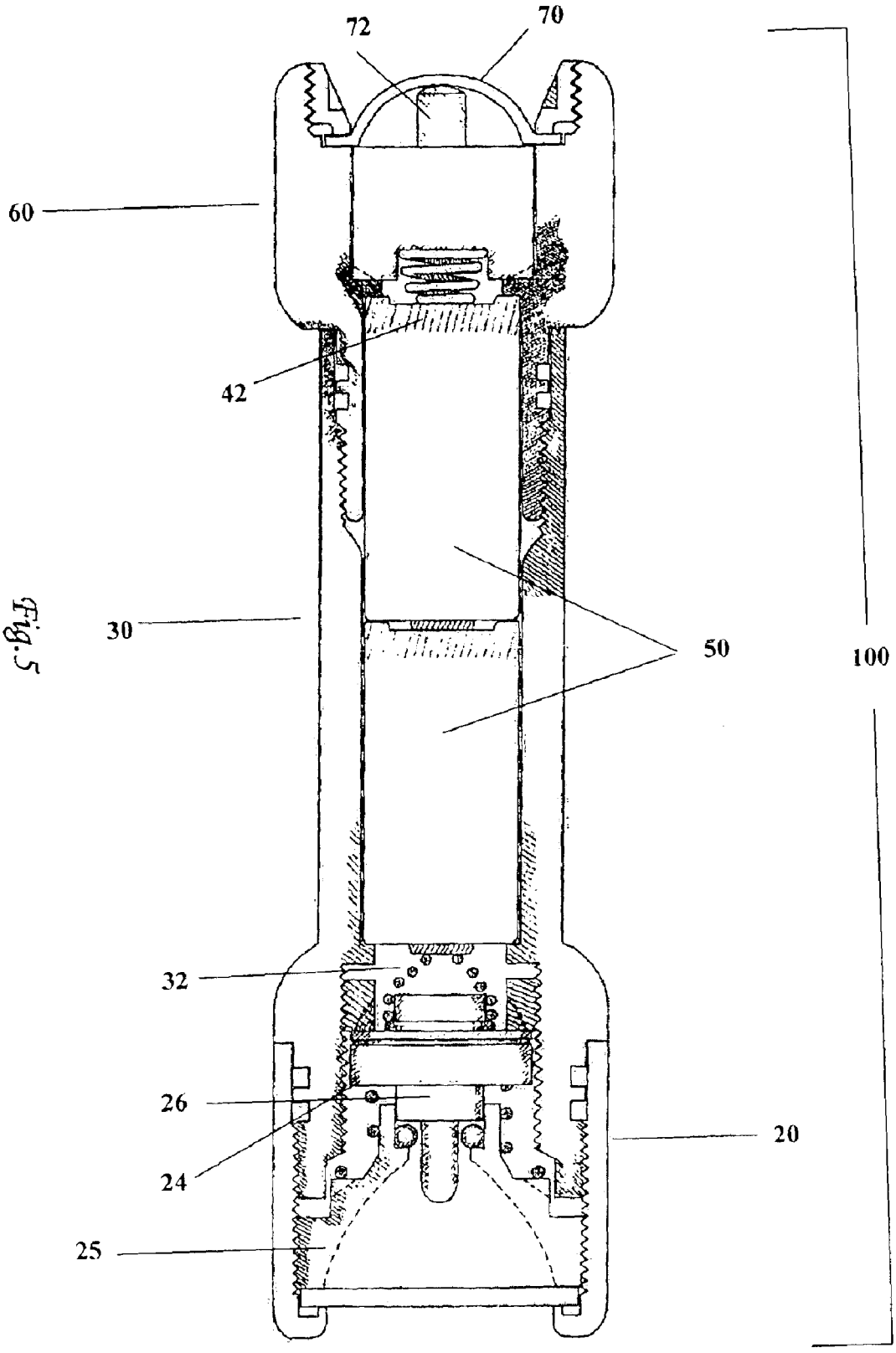
FIG. 5 Diagram of the interior of the current invention.

FIG. 5 shows a cross-sectional view of the present invention, showing the interior detail. In this view, the flashlight 100 is standing on its head. Starting from the top and progressing downward, we come first to the enlarged tail section 60. Within this is the pressure switch 72, covered by the black diaphragm 70. Next comes the middle section 30, which is smaller in diameter (though longer) than the head and the tail section. Within the middle section is found a pair of batteries 50. These are connected to the power switch 72 by a spring 42. At the other end, the batteries are connected to the bulb assembly 26 with spring 32.

Now progressing to the head 20, we see the aforementioned lamp assembly 26 projecting into a parabolic reflector 25, ending at a lens 34. The lamp assembly is held in place by a metallic spring at the front, and a focus adjustment ring 24 at the rear. The entire front end is enclosed by a head bezel 22, which screws onto the body.

The focus adjustment ring 24 controls the position of the bulb within the reflector, and thus the focus of the light beam emanating from the flashlight. This ring 24 can be adjusted manually, but only when the flashlight is not in use. The head of the flashlight, to which the reflector and lens are attached, and the lamp assembly 26 must first be removed. Ring 24 then can be moved by screwing it with the aid of a screwdriver or coin. The ring 24 screwably moves up or down, thus affecting the resting position of lamp assembly 26, and thus the focus of the lamp. Once the head of the flashlight and lamp assembly 26 are replaced, the ring position and focus point remain substantially unchanged, and are unchangeable from outside.

This procedure is intentionally designed to allow the user to 'set-and-forget' the flashlight focus. Typically, whenever the bulb in the lamp assembly burns out, requiring a new lamp assembly to be installed, the focusing procedure must be repeated since no two lamp assemblies are precisely alike. The focus changes the outward appearance of the light emanating from the flashlight. It can appear either as a relatively narrow beam of high intensity, a broad beam of lower intensity, or something in between.

Experience has shown that different users prefer different beam focus settings, and different uses may require the same. However, the focal point generally will not need adjustment during any single mission or outing, or indeed during the life of the bulb. Therefore, it is preferable to minimize the potential for inadvertent adjustment of the focal point during a mission. This is best accomplished, as in the current invention, by protecting the adjustment within the body of the flashlight.

Figure 6:
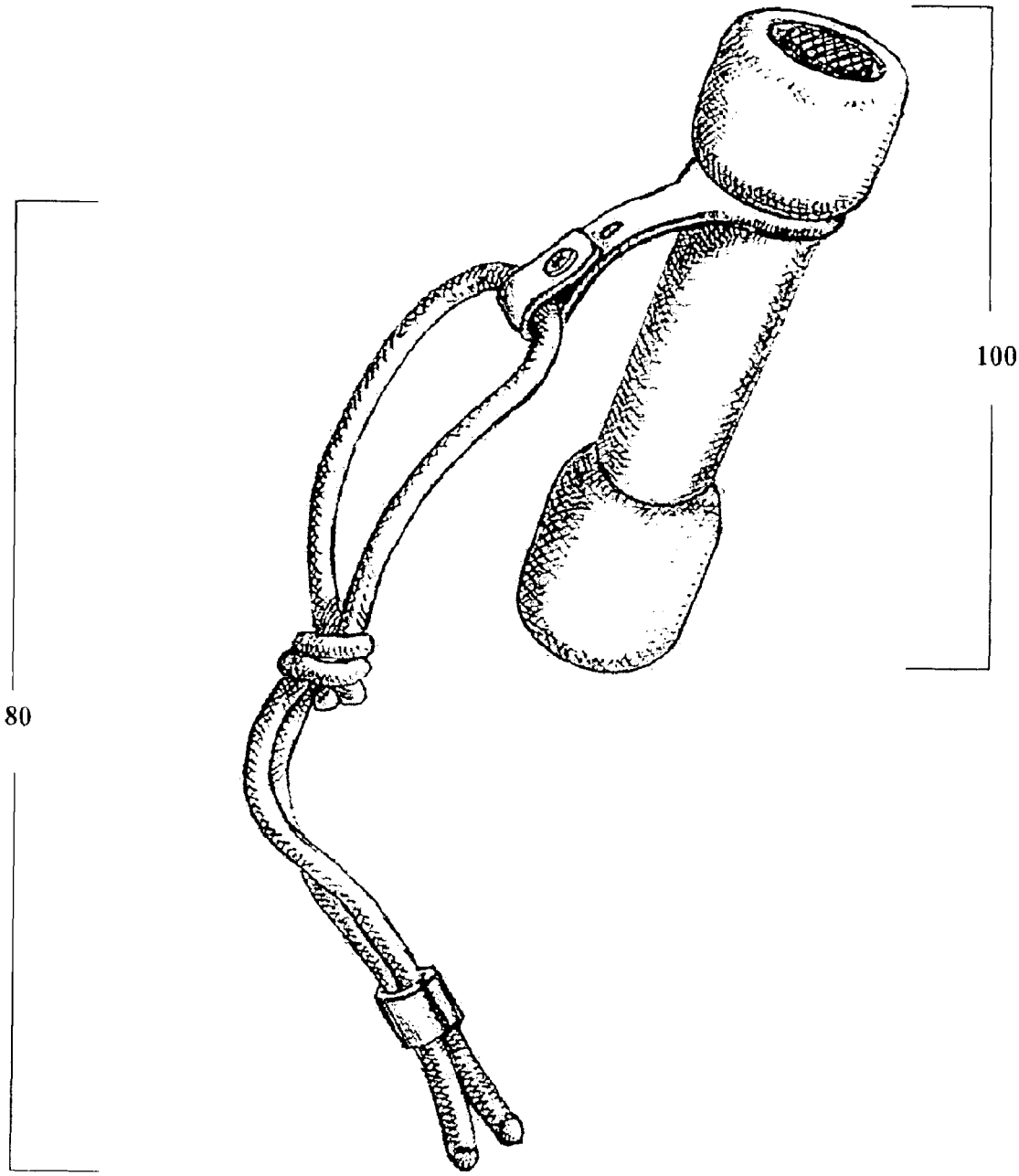
FIG. 6 Shows the invention with optional lanyard.

FIG. 6 shows an optional lanyard accessory 80 affixed to the present invention. The enlarged tail section and head prevent the lanyard attachment device from sliding off the body of the flashlight without requiring any special groove, shoulder, or projection to do so.

The lanyard attachment device can be comprised of any suitable material such as rubber, silicone, polyurethane, or the like. One end is designed to fit snugly around the circular outer surface of the flashlight battery barrel. There is no need for a body-weakening groove in the body of the flashlight, or for a hole, or for a projection to hold the attachment device in place, as it stays effectively in place by friction alone. The other end of the attachment device is designed to secure the lanyard cord. The length of the attachment device is designed to be adjustable for optimum performance with different size hands.

The lanyard rope, or cord, is preferably made of stretchable shock cord and is infinitely adjustable to fit hand or wrist, with clothing worn, by means of knotting them or clipping them together at one or more desired points. The clip holding lanyard cord ends together need not be used, as a simple knot works very well.

Lanyard attachment device 80 is adjustable to fit smaller and larger hands. It is very inexpensive to manufacture—no steel rings, no metal or plastic attachment clip, no slider buttons. It only needs to be adjusted once—no need to pinch open, then move a slider button when putting lanyard on or taking it off. The lanyard is significantly shorter than non-stretch cord, such as used in conventional lanyards, making it easier to deploy, to attach to wrist or hand, and stow away when holstered.

Figure 7:
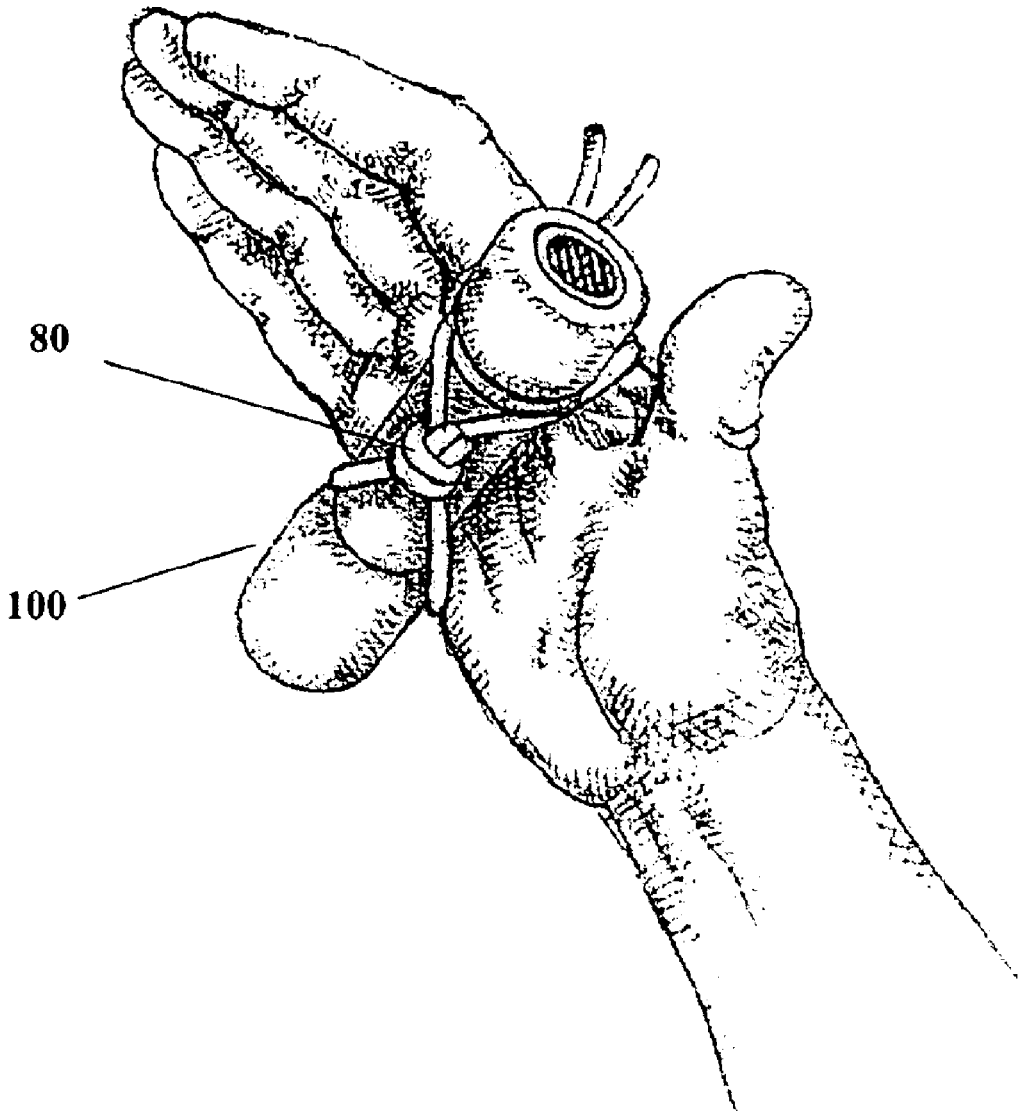
FIG. 7 Shows the invention with optional lanyard in actual use.

The lanyard 80 can be used to attach flashlight to hand or wrist in two different ways. The first method is a standard fashion wrap around the wrist. The second is an in the palm deployment (see FIG. 7). This method has the following advantages: It (a) attaches the flashlight extremely securely, (b) leaves both bands available to grip items, climb ladder, manipulate door knobs, etc., yet (c) leaves flashlight instantly available to be activated with thumb. There is no need for a body-weakening groove in the body of the flashlight, as the lanyard attachment device stays in place by friction. The flashlight remains ready for instant use, yet the fingers and thumb are free to perform other operations, such as picking up objects, climbing a ladder, or opening a door, except during the brief periods when the flashlight must be turned on or off. The thumb is well positioned to activate the power switch 70 at the tail of the flashlight.

Figure 8:
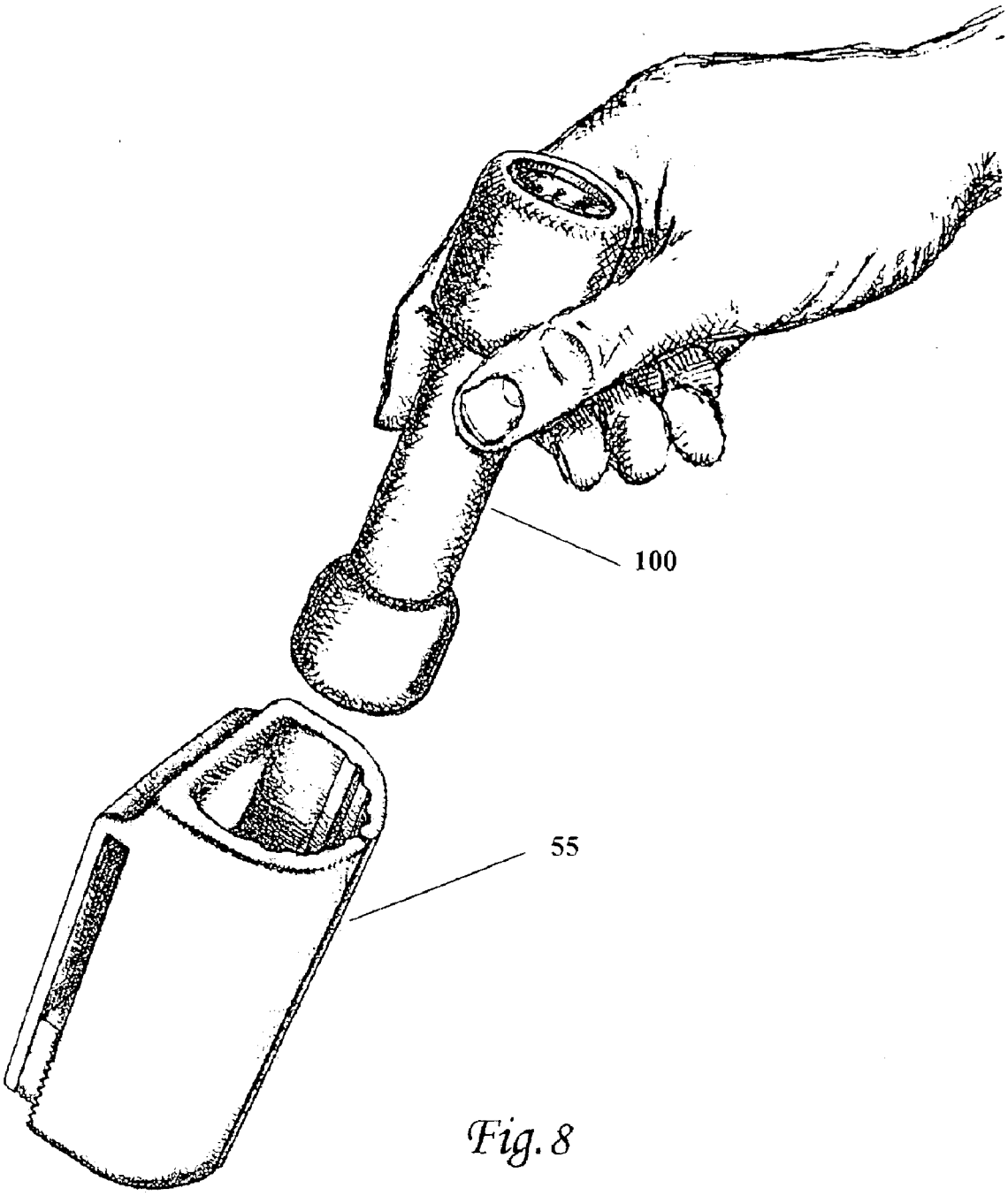
FIG. 8 Shows the invention with optional holster.

FIG. 8 shows a user placing the flashlight in (or removing it from) an optional holster 55. This demonstrates one advantage of the enlarged tail section. Since the tail section and head of the flashlight are of equal diameter, either end may be inserted into a properly sized or shaped holster and the unit will be equally well secured. This is clearly of advantage to a user in a stressful, dark, or otherwise difficult situation, in that the user's attention will be minimally diverted during the exercise of removal or holstering of the flashlight.

Holster 55 is comprised, substantially as shown in FIG. 8, of a flat surface, forming one side of a U-shaped clip for attachment of said holster to a belt, with a substantially cylindrical enclosure connected to a flat wall comprising the other side of the U-shaped clip, and open at one end. The holster may have ribbing or other means internal to the enclosure, for assisting in the retention of the flashlight within the holster.

What is claimed is:

1. A flashlight, comprising a head, for containing a bulb or bulb assembly from which light is emitted; a barrel, for containing batteries for power supply; a power switch; and a tail cap, wherein said head and said tail cap are each at least 25% larger in diameter than said barrel at the boundary between barrel and head, and also at the boundary between barrel and tail cap, said diameters being measured in cross section to the long axis of the flashlight.

2. The flashlight of claim 1, wherein the cross sectional diameter of the head is substantially equal to the cross sectional diameter of the tail cap.

3. The flashlight of claim 1, wherein the end of the head is substantially flat, or slightly concave, such that the flashlight may rest in a stable manner in a vertical position above a supporting surface, with said end facing the supporting surface, and the body of the flashlight extending above said surface.

4. The flashlight of claim 1, wherein the end of the tail cap is substantially flat, or slightly concave, such that the flashlight may rest in a stable manner in a vertical position above a supporting surface, with said end facing the supporting surface, and the body of the flashlight extending above said surface.

5. The flashlight of claim 1, wherein the power switch for operating said light is located in the tail cap.

6. The flashlight of claim 1, wherein the surface of the barrel is covered with a non-slippery material to aid in gripping the flashlight.

7. The flashlight of claim 1, wherein the surface of the barrel is knurled, crosshatched, or similarly patterned to aid in gripping the flashlight.

8. The flashlight of claim 1, wherein the length of the barrel is sufficient for a person to grasp said barrel with at least 2 fingers between the head and the tail cap.

9. The flashlight of claim 1, wherein the power for lighting the flashlight is supplied by a battery, a plurality of batteries, or a rechargeable battery pack.

10. The flashlight of claim 9, wherein said batteries are comprised of lithium batteries or a rechargeable battery pack.

11. The flashlight of claim 1, wherein said flashlight is substantially waterproof to the depths reached in normal SCUBA diving.

12. The flashlight of claim 11, wherein said flashlight is rated for 30 meters immersion.

13. The flashlight of claim 1, wherein all or part of the flashlight except the bulb and batteries is comprised of a structure formed from aluminum or another metallic material, or of a rigid polymer.

14. The flashlight of claim 1, wherein said flashlight may be inserted in a holster with either end first entering, the retention of said flashlight in said holster not being substantially affected or influenced by which end first entered said holster.

15. The flashlight of claim 1, wherein said bulb is an incandescent light bulb.

16. The flashlight of claim 1, wherein said bulb assembly is comprised of a light emitting diode or a plurality of light-emitting diodes (LEDs).

17. A lanyard, comprised of an attachment device made of leather, plastic, polymer, or an elastomer such as rubber, silicone or polyurethane, or any combination thereof, wherein one end is designed to fit snugly around the surface of the flashlight of claim 1; and, at the other end, comprising a loop or molded tunnel through which a rope-like strand passes, which strand may be knotted together, or otherwise connected via a suitable connector, in one or more locations along the length of said strands.

18. A holster for the flashlight of claim 1, which holster comprises:

a flat surface, itself forming one side of a U-shaped clip for attachment of said holster to a belt;

a substantially cylindrical enclosure connected to a flat wall comprising the other side of the U-shaped clip, and open at one end;

wherein said holster is shaped to accommodate a flashlight in secure fashion.

19. The holster of claim 18, further comprising ribs or bands within said enclosure to assist in the retention of a flashlight.

* * * * *